United States Patent [19]

LeBlanc

[11] Patent Number: 4,838,772

[45] Date of Patent: Jun. 13, 1989

[54] CARTRIDGE ROTARY VANE PUMP

[75] Inventor: Joseph A. LeBlanc, Glen Ellyn, Ill.

[73] Assignee: Gast Manufacturing Corporation, Benton Harbor, Mich.

[21] Appl. No.: 602,769

[22] Filed: Apr. 23, 1984

Related U.S. Application Data

[63] Continuation of Ser. No. 118,539, Feb. 4, 1980, abandoned, which is a continuation of Ser. No. 858,017, Dec. 6, 1977, Pat. No. 4,204,815.

[51] Int. Cl.[4] ..... F04C 27/02; F04C 23/00

[52] U.S. Cl. ..... 418/13; 418/70; 418/96; 417/360

[58] Field of Search ..... 403/300, 302, 306, 313; 417/360; 418/70, 96, 13, 270

[56] References Cited

U.S. PATENT DOCUMENTS

| | | | |
|---|---|---|---|
| 1,241,100 | 9/1917 | Eden | 464/115 |
| 1,672,205 | 6/1928 | Eisler | 418/13 |
| 1,714,818 | 5/1929 | Reed . | |
| 2,062,045 | 11/1936 | Van Deventer | 418/13 X |
| 2,193,273 | 3/1940 | Dietzel | 418/70 |
| 2,902,210 | 9/1959 | Power . | |
| 3,237,851 | 3/1966 | LeBlanc, Jr. . | |
| 3,399,826 | 9/1968 | Andriulis . | |
| 3,507,129 | 4/1970 | Tarenskeen | 403/306 X |
| 3,525,578 | 8/1970 | LeBlanc, Jr. . | |
| 3,620,656 | 11/1971 | Sharples . | |
| 3,782,868 | 1/1974 | LeBlanc, Jr. | 418/96 |
| 3,838,950 | 10/1974 | Andriulis . | |
| 3,901,631 | 8/1975 | Wickham et al. . | |

*Primary Examiner*—Leonard E. Smith

*Attorney, Agent, or Firm*—Price, Heneveld, Cooper, DeWitt & Litton

[57] ABSTRACT

A rotary vane vacuum pump includes a drive unit, such as an electric motor, and a pump unit, preferably constructed as a cartridge pump unit. The drive unit may take any suitable form, but the cartridge unit includes one or more pumping stages plus a pumping stage of small dimension to lower pressure and increase outgassing of the lubricant. The rotors of the rotary vane pump unit are shaftless, that is they together form an axis of rotation without a separate axial shaft and are thus simplified in construction. All of the requirements of oiling, outgassing and gas ballast are fulfilled in the additional stage.

9 Claims, 4 Drawing Sheets

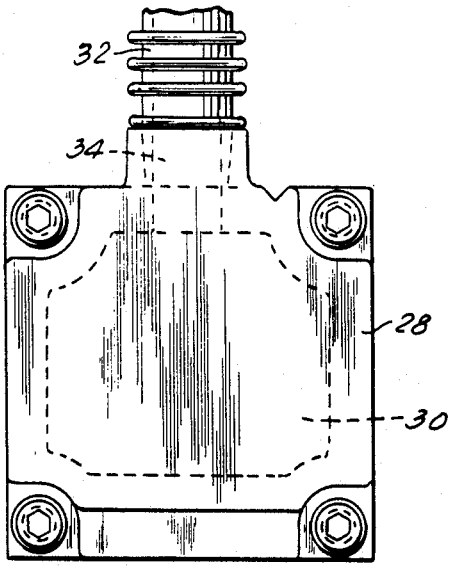
Fig. 5
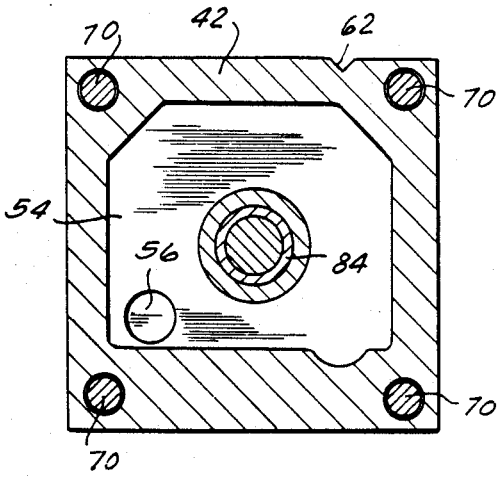
Fig. 6
Fig. 8
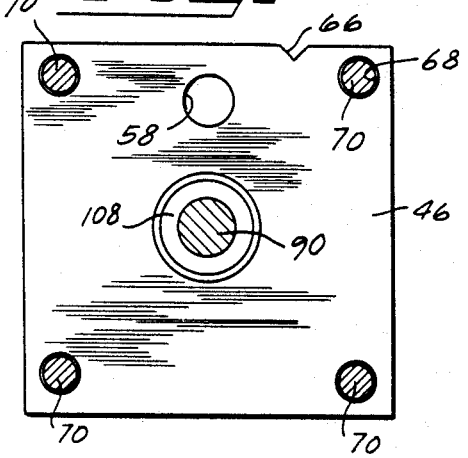
Fig. 7
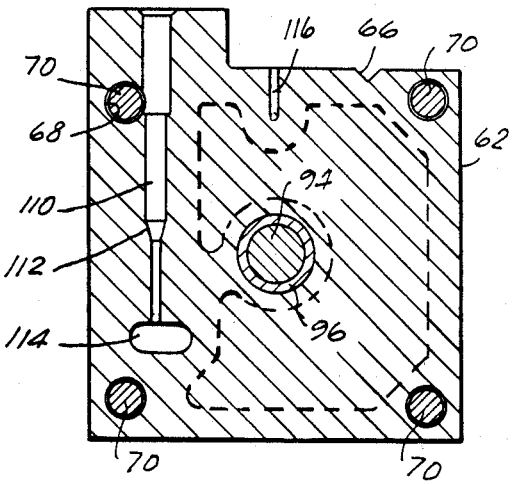

Fig. 9
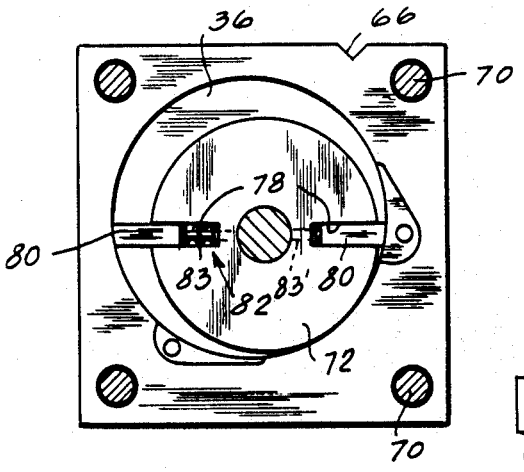
Fig. 10
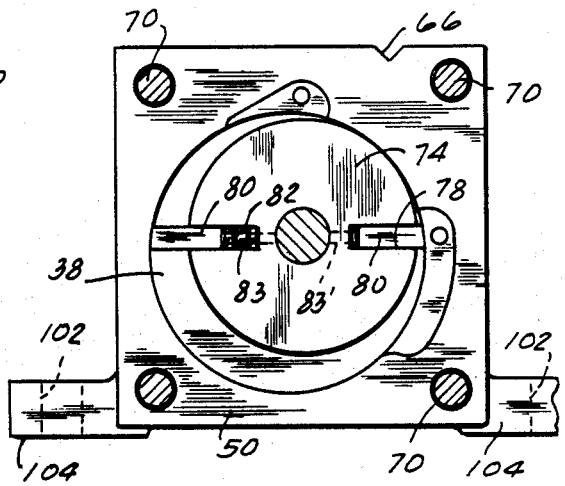
Fig. 11
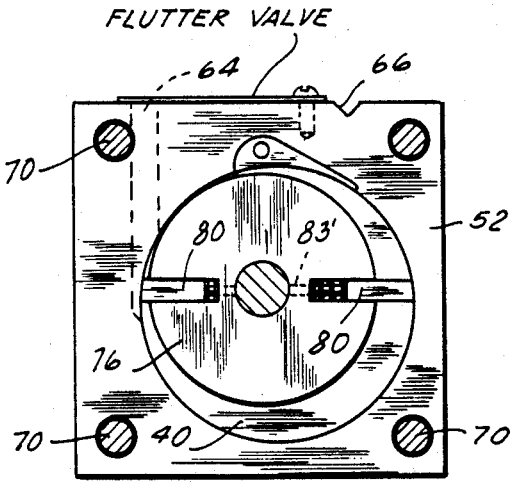
Fig. 12
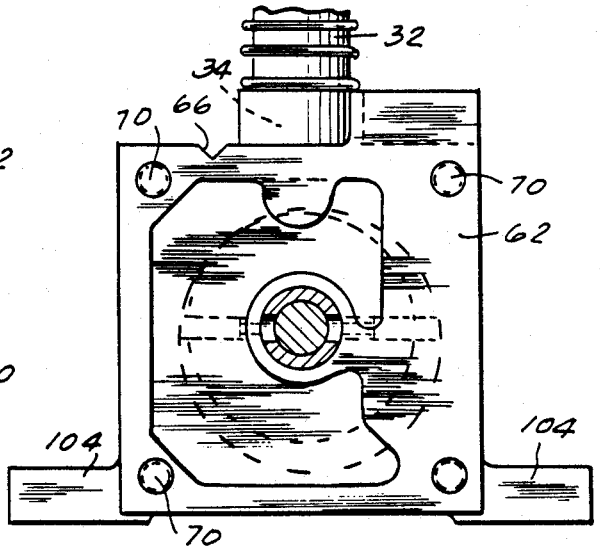
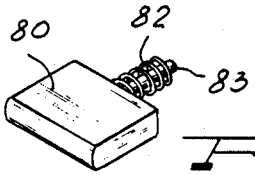
Fig. 13

CARTRIDGE ROTARY VANE PUMP

This is a continuation of application Serial No. 118,539, filed Feb. 4, 1980, now abandoned, which is a continuation of application Ser. No. 858,017, filed Dec. 6, 1977, now U.S. Pat. No. 4,204,815, issued May 27, 1980.

BACKGROUND OF THE INVENTION

1. Field of the Invention

The present invention relates to rotary vane pumps, and is particularly concerned with high vacuum rotary vane pumps which may be simply constructed in cartridge form.

2. Background of the Invention

The construction of rotary vane pumps is wide and varied, but basically all such pumps include one or more rotors which are rotatable in a like number of eccentrically disposed, serially connected pumping chambers which define a low pressure output side of the pump.

Various techniques for improving pump operation and pumping efficiency have heretofore been devised. For example, in my earlier U.S. Pat. No. 3,782,868, entitled "Rotary Vane Pump" I disclose structure for noise free lubrication of the pump.

In present high vacuum pumps oil for lubrication and leakage sealing is permitted to enter, in fact is drawn into, the exhaust stage of a pump and, due to occluded gasses, adversely affects the pressure of the inlet stage to an intolerable degree.

SUMMARY OF THE INVENTION

The primary object of the invention is to provide a new and improved rotary vane vacuum pump.

Another object of the invention is to provide a vacuum pump of simple construction which may be constructed as a cartridge type pump.

A particular object of the invention is to provide a pump cartridge which is readily adaptable to a plurality of pump structures. More specifically, this object includes the desire to provide an easily manufactured and assembled pump cartridge structure.

Another object of the invention is to provide a rotary vane vacuum pump which is virtually noise free, with respect to outgassing of the lubricant, without requiring special additional structures for noise suppression.

According to the invention, a pump of one or more stages, hereinafter referred to as 1+, 2+, etc. stages, is provided with an additional stage, the (+) stage, of small axial dimension, whereby oil which is permitted to enter the inlet cycle becomes exposed to lower than normal pressure, thereby increasing the outgassing rate. This degassed oil is, in turn, flowed through the common stages allowing the pump to reach lower pressures at an increased rate of time.

Another feature of the invention is to provide, by way of the additional (+) stage, a constant gas ballast (air entering the exhaust cycle to cleanse the lubricating oil) without adversely affecting the ultimate pressure of the pump. Also, a variable gas ballast with a more finite control should be provided.

According to another feature of the invention, the additional stage, the (+) stage, permits a high vacuum rotary pump to be constructed in cartridge form with more reliable results.

Another feature of the invention is to provide a rotor structure which may be easily and simply constructed, preferably without a rotor shaft. In this preferable construction each rotor includes a central, axially extending threaded section which is received in an axial, threaded bore of an associated section of the adjacent rotor.

BRIEF DESCRIPTION OF THE DRAWINGS

Other objects, features, and advantages of the invention, its organization, construction and operation will become apparent and the invention will be best understood from the following detailed description, taken with the accompanying drawings, on which:

FIG. 5 is a trap-end view of the cartridge of FIG. 3 taken along the line V—V;

FIG. 6 is a sectional view taken along the line VI—VI of FIG. 3;

FIG. 7 is a sectional view taken along the line VII—VII of FIG. 3;

FIG. 8 is a sectional view taken along the line VIII—VIII of FIG. 3;

FIG. 9 is a sectional view taken along the line IX—IX of FIG. 3;

FIG. 10 is a sectional view taken along the line X—X of FIG. 3;

FIG. 11 is a sectional view of the structure taken along the line XI—XI of FIG. 3;

FIG. 12 is a drive end view taken along the line XII—XII of FIG. 3; and

FIG. 13 is a perspective view of the vane structure.

DESCRIPTION OF THE PREFERRED EMBODIMENTS

Figure 1:
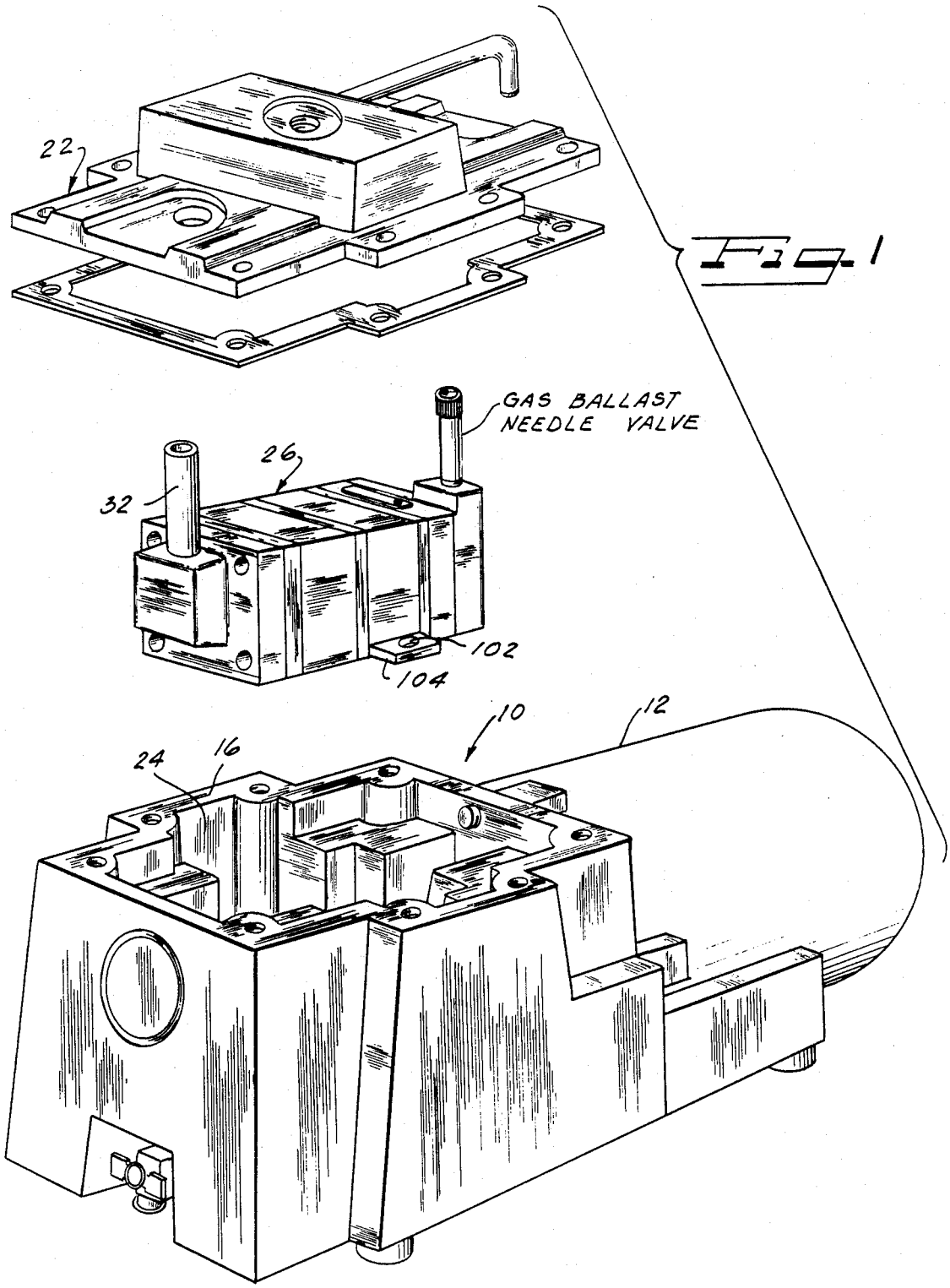
FIG. 1 is a perspective view of a pump constructed in accordance with the present invention.
Figure 2:
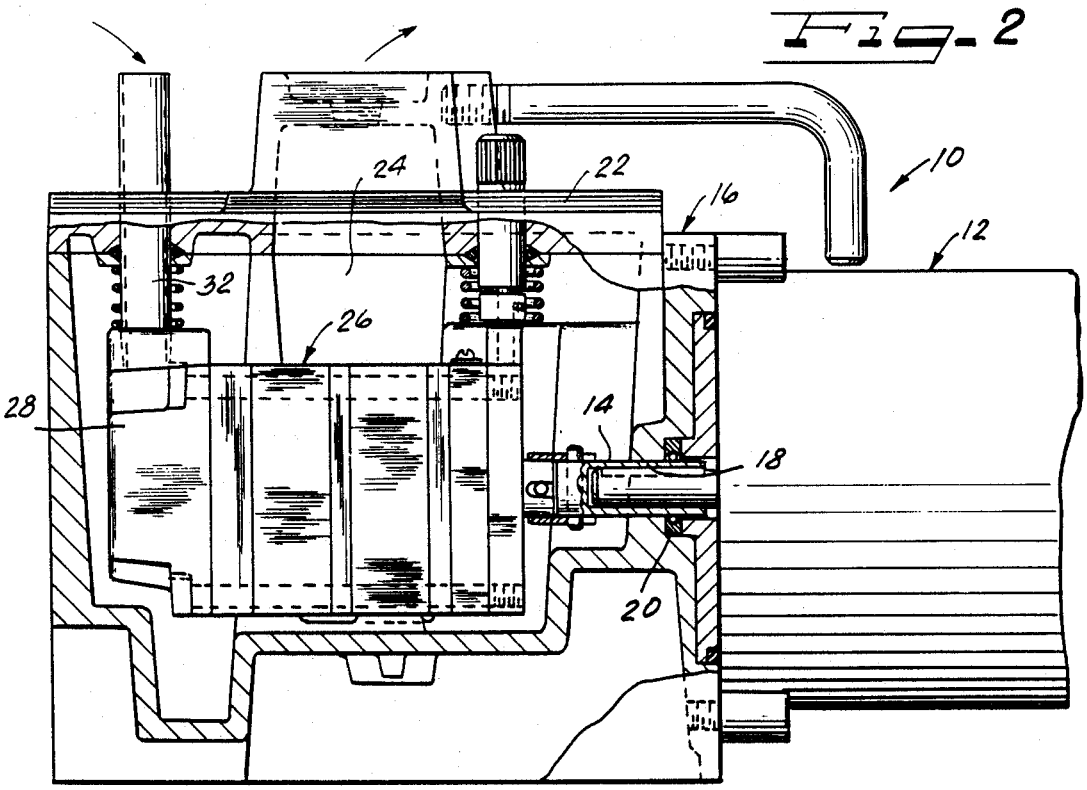
FIG. 2 is an elevational sectional view of a pump constructed in accordance with the present invention.
Figure 3:
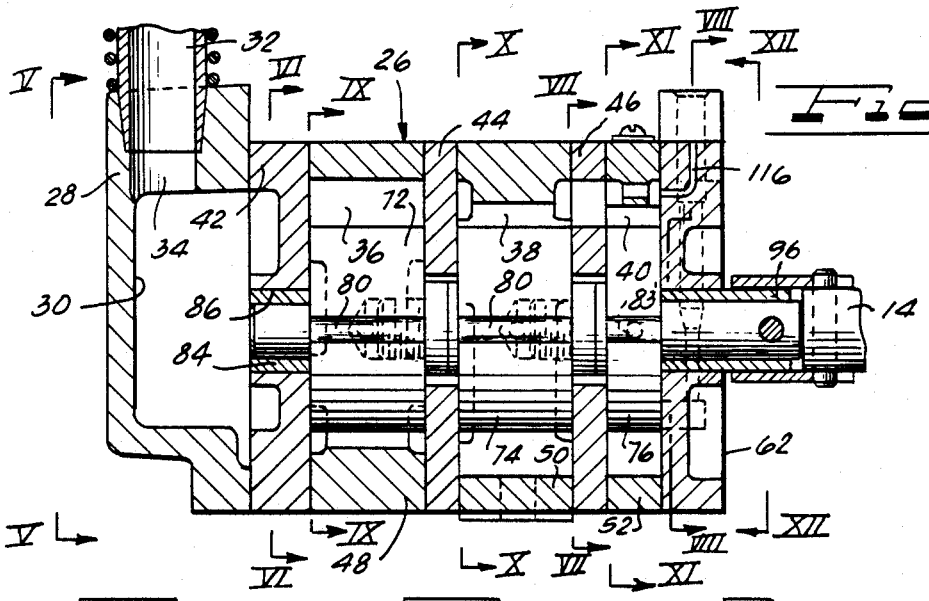
FIG. 3 is an elevational sectional view of a cartridge of a pump constructed in accordance with the invention.

Referring to FIGS. 1, 2, and 3, a pump 10 that is an electric motor, is illustrated as comprising a prime mover 12, having an output shaft 14 which extends into a pump housing 16 through an aperture 18 via a seal 20.

The housing 16 has a cover 22 and together therewith defines a chamber 24 which receives and mounts therein a pump cartridge 26. The pump cartridge 26 includes a first end plate 28 (FIGS. 2 and 5) having a recess 30 therein which is in fluid communication with a conduit 32 through a port 34 (also see FIG. 13). In the specific embodiment illustrated three pumping chambers 36, 38, and 40 are connected in fluid communication with the recess 30, as illustrated in FIGS. 9, 10, and 11, respectively, by way of a plurality of intermediate plates 42, 44, and 46.

Each of the chambers 36, 38, and 40 are defined by respective bores in respective stators 48, 50, and 52 while: the plate 42 (FIG. 6) includes a recess 54 and a bore 56 communicating between the recess 30 and the chamber 36; the plate 44 includes a bore (not shown) communicating the chamber 36 with the chamber 38; and the plate 46, an outgassing exhaust end plate, includes a bore 58 communicating the chamber 38 with a port 114 in an end plate 62 (FIG. 8), and with a port 64 (FIG. 11). Each of the bores in the stators communicates through recesses relieved in the faces of the stators, as is common practice. Each of the plates and stators includes a notch 66 (see FIGS. 8 and 9 for example) therein for alignment during assembly and each includes a plurality of bores 68 for receiving a fastener 70 therein such as a bolt, rivit or the like.

The pumping chamber 36 in the stator 48 has a rotor 72 therein; the pumping chamber 38 in the stator 50 has a rotor 74 therein; and the pumping chamber 40 in the stator 52 has a rotor 76, the (+) rotor, therein. As illustrated, for example, FIG. 10, each of the rotors 72, 74, and 76 has at least one radially directed slot 78 therein which receives a slideable vane 80 which is spring loaded, as at 82, (FIG. 5) the spring 82 being on a pin 83 received in a bore 83.

Figure 4:
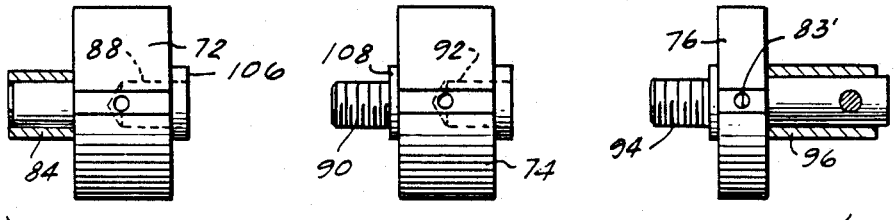
FIG. 4 is an exploded view of a 2+1 pump rotor according to the invention.

Referring to FIG. 4, a particular feature of the invention is illustrated, in the context of the embodiment of FIGS. 1, 2, and 3. In FIG. 4, a first rotor 72 is illustrated as including an axial projection 84 for rotational reception in a bore 86 in the plate 42 and a threaded axial recess 88 for receiving a threaded axial projection 90 of the rotor 74. The rotor 74 also includes a threaded axial bore 92 which receives a threaded projection 94 of the rotor 76 which also has an axial projection 96. Projection 96 includes a transversely extending slot 98 (FIGS. 2, 3 and 12) for receiving pin 77 extending through a cylindrical coupling sleeve 97 (FIGS. 2 and 3). The end of sleeve 97 remote from pin 77 includes a cross pin 99 extending through shaft 14 (FIG. 3) for securing the coupling to the shaft. Slot 98 and pin 77 provide a disconnectable coupling for driving connection of rotor 76 to the output shaft 14 of the prime mover 12. The rotors are therefore constructed for a shaftless assembly which greatly simplifies assembly and final machining of the components.

After assembly of the cartridge 26, the same may be coupled to the drive shaft 14 and removable mounted in the chamer 24, as illustrated in FIG. 2, a pair of machine screws (not shown) which extend downwardly through a pair of bores 102 in a pair of bosses 104 as seen in FIGS. 1, 10, and 12.

As shown in FIG. 4, each of the rotors has at least one axial projection or collar 106 which abuts a facing collar 108 of the adjacent rotor to space the rotors so as to receive the imtermediate plates therebetween. It is readily apparent from the structure of FIGS. 3 and 4 that finishing and balancing of a rotor assembly is greatly simplified by the present invention in that there is no rotor shaft per se as a separate part and therefore no force fit of rotors on a shaft and no cracking or rotor-shaft slippage. If the rotor assembly is to be driven from the intake end, opposite thread direction may be used.

An previously mentioned, high vacuum pumps require oil for lubrication. In the present invention the chamber 24 may advantageously be a reservoir for lubricating oil as well as a repository for the cartridge 26. The added stage, the (+) stage including the rotor 76, which permits the oil to enter the cartridge through a passageway 116 in the end plate 62 during the inlet cycle, creates an extremely low pressure in the exhaust stage and exposes the lubricating oil to this pressure to increase outgassing. The degassed oil then is flowed through all of the small spaces of the cartridge for lubrication of the stages. A constant gas ballast (air entering the exhaust cycle to cleanse the oil) is therefore established without adversely affecting the ultimate pressure of the pump. This ballast may be adjusted by a needle valve (not shown) in the valve passageway 110 in FIG. 8 which has a valve seat 112 in communication with a slot 114 which extends to the exterior of the cartridge.

In summary, the oiling, gas ballast and degassing requirements of high vacuum rotary vane pumps have been provided in a pump, in particular a pump cartridge, not in a manner heretofore conventional where each requirement was fulfilled at various locations in a pump, but uniquely all requirements are met in a single stage, the (+) stage. This novel construction advantageously lends itself to cartridge form and the unique cartridge structure, including the novel rotor arrangement, simplifies production and makes refurbrishing fast, easy and economical.

Although I have described my invention by reference to a particular illustrative embodiment thereof, many changes and modifications may become apparent to those skilled in the art without departing from the spirit and scope of the invention. I therefore intend to include within the patent warranted herein all such changes and modifications as may reasonably and properly be included within the scope of my contribution to the art.

I claim as my invention:

1. A high vacuum rotary vane pump, comprising:

a prime mover including a rotary output shaft;

a pump housing connected to said prime mover and defining a first chamber having sidewalls and a floor for containing a lubricant, wherein one wall of said pump housing includes a seal through which said rotary output shaft of said prime mover extends;

a pump cartridge mounted in said first chamber, said pump cartridge including an inlet, an outlet and at least two pumping chambers respectively adjacent said inlet and outlet, one of said chambers being of less axial dimension than the other of said chambers, at least two serially-connected rotors, rotatably mounted in said chambers, one of said rotors being of complementary axial dimension to and disposed within said one chamber and the other rotor being of complemental axial dimension to and disposed within said other chamber;

means for interconnection of said rotors; and coupling means extending between said rotary shaft of said prime mover and said rotors providing a disconnectable coupling located within said first chamber for permitting said cartridge to be lifted from said first chamber and simultaneously decoupled from said rotary shaft of said prime mover without removing said seal.

2. The pump as defined in claim 1 wherein said cartridge includes a shaft extending therefrom and including slot means extending transversely through said shaft, and said coupling means includes a sleeve coupled at one end to said rotary shaft of said prime mover and including pin means in an opposite end for releasably engaging said slot means of said cartridge shaft.

3. A vacuum pump comprising:

a pump housing having a pump cartridge receiving chamber with an open top, said chamber defining an oil reservoir and including seal means for receiving a prime mover having a drive shaft extending into said chamber;

a pump cartridge including at least one pumping stage and having a rotary shaft for operation of said pumping stage, said rotary shaft including intercoupling means at an end thereof;

coupling means for releasably coupling said drive shaft of said prime mover to said rotary shaft of said pump cartridge, said coupling including means secured at one end to said drive shaft and including interengaging means at the opposite end releasably engaging said intercoupling means at the end of said rotary shaft for permitting quick connecting and disconnecting of said pump cartridge to said prime mover, said interengaging means and said intercoupling means being positioned within said chamber whereby said cartridge can be removed by lifting from said chamber without removing said seal means; and cover means for removably covering said open top of said housing permitting access to said chamber.

4. The pump as defined in claim 3 wherein said interengaging means comprises one of a pin or slot and said intercoupling means comprises the other of a pin or slot.

5. The pump as defined in claim 3 wherein said means secured at one end to said drive shaft comprises a sleeve fitted over said drive shaft.

6. A high vacuum rotary vane pump comprising:

a prime mover including a rotary output shaft;

a pump housing coupled to said prime mover and defining a chamber having sidewalls and a floor for containing a lubricant, said housing having an aperture formed in one of said sidewalls for receiving said rotary output shaft of said prime mover;

seal means extending between said one sidewall and said rotary output shaft for retaining said lubricants within said chamber and allowing rotation of said shaft;

A pump cartridge with an axial projection for coupling said pump cartridge to said rotary output shaft of said primer mover for driving said pump cartridge, said pump cartridge including an end plate through which said axial projection extends; and means coupled to said axial projection and said rotary output shaft and positioned within said chamber between said end plate of said pump cartridge and said one sidewall of said housing for disconnectably coupling said rotary output shaft of said prime mover to said axial projection of said pump cartridge whereby said pump cartridge can be removed by lifting from said chamber. without removal of said seal means and loss of lubricant through said aperture.

7. The apparatus as defined in claim 6 wherein said means for disconnectably coupling said rotary output shaft and said axial projection includes a sleeve extending over ends of said rotary output shaft and said axial projection.

8. The apparatus as defined in claim 7 and further including a cross pin extending through said sleeve near one end thereof and through said rotary output shaft near an end thereof for securing to said rotary output shaft.

9. The apparatus as defined in claim 8 wherein said sleeve includes a second cross pin extending therethrough near an opposite end of said sleeve and wherein said axial projection includes a slot extending inwardly from an end thereof for receiving and releasably capturing said second cross pin.

* * * * *